US008935949B2

(12) United States Patent
Batt

(10) Patent No.: US 8,935,949 B2
(45) Date of Patent: Jan. 20, 2015

(54) C FRAME STRUCTURE CONFIGURED TO PROVIDE DEFLECTION COMPENSATION AND ASSOCIATED METHOD

(71) Applicant: The Boeing Company, Chicago, IL (US)

(72) Inventor: Edward John Batt, Everett, WA (US)

(73) Assignee: The Boeing Company, Chicago, IL (US)

( * ) Notice: Subject to any disclaimer, the term of this patent is extended or adjusted under 35 U.S.C. 154(b) by 174 days.

(21) Appl. No.: 13/647,823

(22) Filed: Oct. 9, 2012

(65) Prior Publication Data

US 2014/0100695 A1 Apr. 10, 2014

(51) Int. Cl.
*B21J 15/10* (2006.01)
*B30B 15/04* (2006.01)

(52) U.S. Cl.
USPC ..... 72/455; 72/450; 100/231

(58) Field of Classification Search
USPC ..... 100/231; 72/451, 455, 456, 450, 453.03
See application file for complete search history.

(56) References Cited

U.S. PATENT DOCUMENTS 4,262,588 A * 4/1981 McDonald ..... 100/234
4,406,151 A * 9/1983 Simonsen et al. ..... 72/478
4,448,119 A * 5/1984 Williamson ..... 100/231
5,174,174 A 12/1992 Schroeder
8,200,354 B2 6/2012 Freeman et al.
8,630,729 B2 1/2014 Freeman et al.
8,666,546 B2 3/2014 Sarh et al.
8,812,154 B2 8/2014 Vian et al.

FOREIGN PATENT DOCUMENTS

DE 198 19 721 A1 11/1999
DE 10 2007 020166 A1 10/2008
DE 10 2007 020167 A1 11/2008
WO WO 2013/113052 A1 8/2013

OTHER PUBLICATIONS

International Search Report and Written Opinion for Application No. PCT/US2013/059164 dated Dec. 20, 2013.

* cited by examiner

*Primary Examiner* — David B Jones
(74) *Attorney, Agent, or Firm* — Alston & Bird LLP

(57) ABSTRACT

A C frame structure, a robotic system and an associated method are provided respond to and accommodate the loads placed upon the C frame structure during actuation of a working tool. The C frame structure includes a plurality of links and a plurality of pins interconnecting the links to form a pinned truss configuration. The pinned truss configuration is responsive to loads imparted in response to actuation of the tool such that each link is placed in compression or tension. The C frame structure also includes a plurality of hydraulic cylinders connected to the links such that each hydraulic cylinder extends in parallel to a respective link. A first hydraulic cylinder operates in a compression mode in response to strain attributable to actuation of the tool. A second hydraulic cylinder operates in an extension mode in response to the first hydraulic cylinder operating in the compression mode.

20 Claims, 6 Drawing Sheets

C FRAME STRUCTURE CONFIGURED TO PROVIDE DEFLECTION COMPENSATION AND ASSOCIATED METHOD

TECHNOLOGICAL FIELD

A C frame structure for carrying a working tool is provided in accordance with one embodiment of the present disclosure and, more particularly, a C frame structure configured to respond to loads generated by the working tool by compensating for deflection otherwise created by the loads.

BACKGROUND

A number of structures must be riveted and, indeed, some structures require hundreds or thousands of rivets to be installed. By way of example, a wing of an aircraft may require the installation of many rivets. In order to facilitate the installation of rivets, riveters have been developed that have first and second riveting assemblies that are positioned in alignment with one another proximate opposite surfaces of the structure, such as opposite surfaces of a wing. These riveters permit a rivet to be properly positioned and then installed and upset.

The installation and upsetting of a rivet may generate substantial force upon the riveter and may urge the first and second riveting assemblies positioned in alignment with one another proximate the opposite surfaces of the structure to be deflected away from the structure. Such deflection of the riveting assemblies may be deleterious in that their relative location with respect to the structure may be altered during the rivet installation process, thereby potentially causing the rivet to be mispositioned or misaligned. Additionally, the deflection of the riveter may cause the riveter to require maintenance sooner or more frequently than is desired and may sometimes shorten its useful life.

As such, riveters have been developed that are substantial in size and weight in order to withstand the deflection forces created during the riveting process. While these more substantial riveters may generally maintain their relative position with respect to the structure in which a rivet is being installed, the size and weight of these riveters may limit their mobility or portability. Thus, these more substantial riveters are oftentimes stationary such that the structure to be riveted, such as a wing, must be moved into alignment with the riveter and then repeatedly repositioned with respect to the riveter as each rivet is installed and upset. This process of positioning and then repositioning a structure, such as a wing, relative to the riveter may limit the flexibility of the manufacturing process by requiring the riveter to remain stationary and by correspondingly requiring the structure to be riveted to be carried by a material handling system that is sufficiently sophisticated to controllably position the structure, such as a relatively large structure such as a wing, in a number of relatively precise positions with respect to the riveter.

BRIEF SUMMARY

A C frame structure, a robotic system and an associated method are provided in accordance with an example embodiment of the present disclosure in order to respond to and accommodate the loads placed upon the C frame structure during actuation of a working tool, such as the deflection loads created during a riveting operation. The C frame structure of an example embodiment of the present disclosure may not only respond to and accommodate the loads created during operation, but may do so in a manner that reduces or eliminates the deflection of the C frame structure. Thus, the C frame structure to be lighter and therefore have increased mobility. For example, the C frame structure may be carried by a robot during performance of its operations, thereby increasing the efficiency of the manufacturing process by permitting the C frame structure and its associated working tool to be controllably positioned relative to a structure, such as a wing, thereby potentially reducing the handling and positioning required of the structure during the manufacturing process.

In one embodiment, a C frame structure for carrying a tool is provided that includes a plurality of links and a plurality of pins interconnecting the links to form a pinned truss configuration. At least one of the links is configured to carry the tool. In this embodiment, the pinned truss configuration of the links is responsive to a load imparted upon the C frame structure in response to actuation of the tool such that each link is placed in compression or tension. The links that are configured to be placed in tension may be formed of an anisotropic material, such as a composite material. The links configured to be placed in compression may be formed of a metal. The C frame structure of this embodiment also includes a plurality of hydraulic cylinders including first and second hydraulic cylinders connected to the plurality of links such that each hydraulic cylinder extends in parallel to a respective link. The first hydraulic cylinder of this embodiment is configured to operate in a compression mode in response to strain within the C frame structure attributable to actuation of the tool. The second hydraulic cylinder of this embodiment is configured to be in an extension mode in response to the first hydraulic cylinder operating in the compression mode.

The first and second hydraulic cylinders of one embodiment are in fluid communication such that the hydraulic fluid forced out of the first hydraulic cylinder in the compression mode is provided to the second hydraulic cylinder. Each of the first and second hydraulic cylinders of this embodiment includes a piston. As such, the first hydraulic cylinder may be configured to cause its respective piston to force hydraulic fluid out of the first hydraulic cylinder in the compression mode. In another embodiment, the C frame structure includes an external hydraulic control system configured to direct hydraulic fluid to the second hydraulic cylinder in response to operation of the first hydraulic cylinder in the compression mode.

In another embodiment, a robotic system is provided that includes a robot configured to provide for controlled movement and a C frame structure carried by the robot. The C frame structure may include a pinned truss configuration that includes a plurality of links interconnected by pins. The C frame structure of this embodiment also includes a plurality of hydraulic cylinders including first and second hydraulic cylinders connected to the plurality of links such that each hydraulic cylinder extends in parallel to a respective link. The robotic system of this embodiment may also include a tool, such as a riveter, carried by at least one of the links. The pinned truss configuration of one embodiment is responsive to a load imparted upon the C frame structure in response to actuation of the tool by the robot such that each link is placed in compression or tension. The links configured to be placed in tension may be formed of an anisotropic material, such as a composite material. The links configured to be placed in compression may be formed of a metal. The first hydraulic cylinder of this embodiment is configured to operate in a compression mode in response to strain within the C frame structure attributable to actuation of the tool. The second hydraulic cylinder of this embodiment is configured to be in an extension mode in response to the first hydraulic cylinder operating in the compression mode.

The first and second hydraulic cylinders of one embodiment may be in fluid communication such that the hydraulic fluid forced out of the first hydraulic cylinder in the compression mode is provided to the second hydraulic cylinder. In this embodiment, each of the first and second hydraulic cylinders may include a piston. As such, the first hydraulic cylinder may be configured to cause the respective piston to force hydraulic fluid out of the first hydraulic cylinder in the compression mode. The robotic system of another embodiment may also include an external hydraulic control system configured to direct hydraulic fluid to the second hydraulic cylinder in response to operation of the first hydraulic cylinder in the compression mode.

In a further embodiment, a method for accommodating deflection upon actuation of a tool is provided that includes providing a C frame structure. The C frame structure includes a pinned truss configuration that includes a plurality of links interconnected by pins and a plurality of hydraulic cylinders connected to the plurality of links such that each hydraulic cylinder extends in parallel to a respective link. The method of this embodiment also includes actuating the tool, such as a riveter, carried by the C frame structure. The pinned truss configuration of the links is responsive to a load imparted upon the C frame structure in response to the actuation of the tool such that each link is placed in compression or tension. The method of this embodiment also includes causing the first hydraulic cylinder to operate in a compression mode in response to strain within the C frame structure attributable to the actuation of the tool. The method of this embodiment also causes the second hydraulic cylinder to operate in an extension mode in response to the first hydraulic cylinder operating in the compression mode.

In regards to the operation of the first hydraulic cylinder in the compression mode, the method of one embodiment may force hydraulic fluid out of the first hydraulic cylinder in the compression mode. In this embodiment, the operation of the second hydraulic cylinder in the extension mode may include providing the hydraulic fluid forced out of the first hydraulic cylinder to the second hydraulic cylinder. Each of the first and second hydraulic cylinders of one embodiment may include a piston. In this embodiment, the method may force the hydraulic fluid out of the first hydraulic cylinder by causing the respective piston to force hydraulic fluid out of the first hydraulic cylinder in the compression mode. In regards to causing the first hydraulic cylinder to operate in the compression mode, the method of another embodiment may cause hydraulic fluid to be forced from the first hydraulic cylinder to an external hydraulic control system. In regards to causing the second hydraulic cylinder to operate in the extension mode, the method of this embodiment may cause the external hydraulic control system to direct hydraulic fluid to the second hydraulic cylinder in response to operation of the first hydraulic cylinder in the compression mode.

BRIEF DESCRIPTION OF THE DRAWINGS

Figure 1:
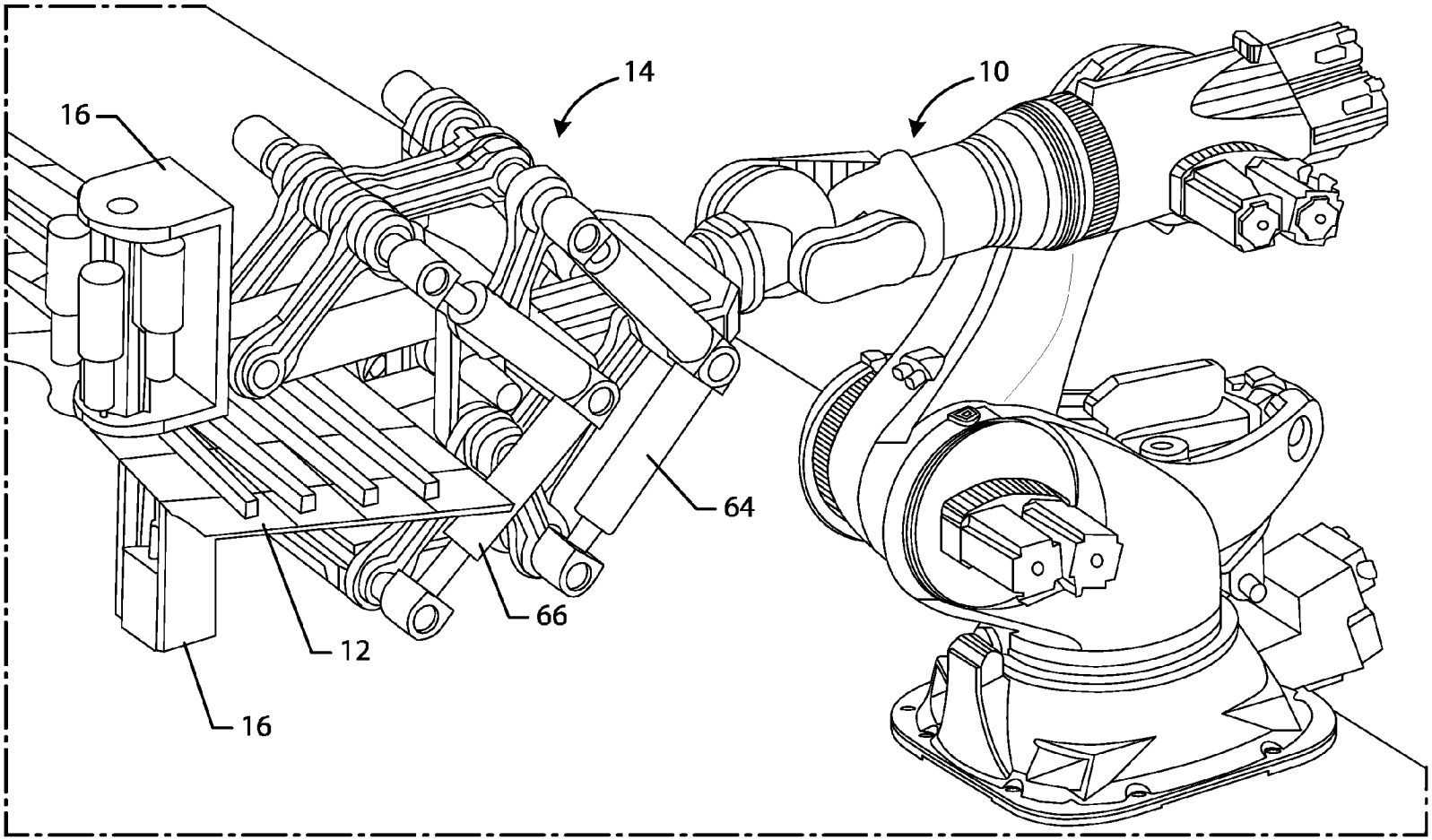
Figure 2:
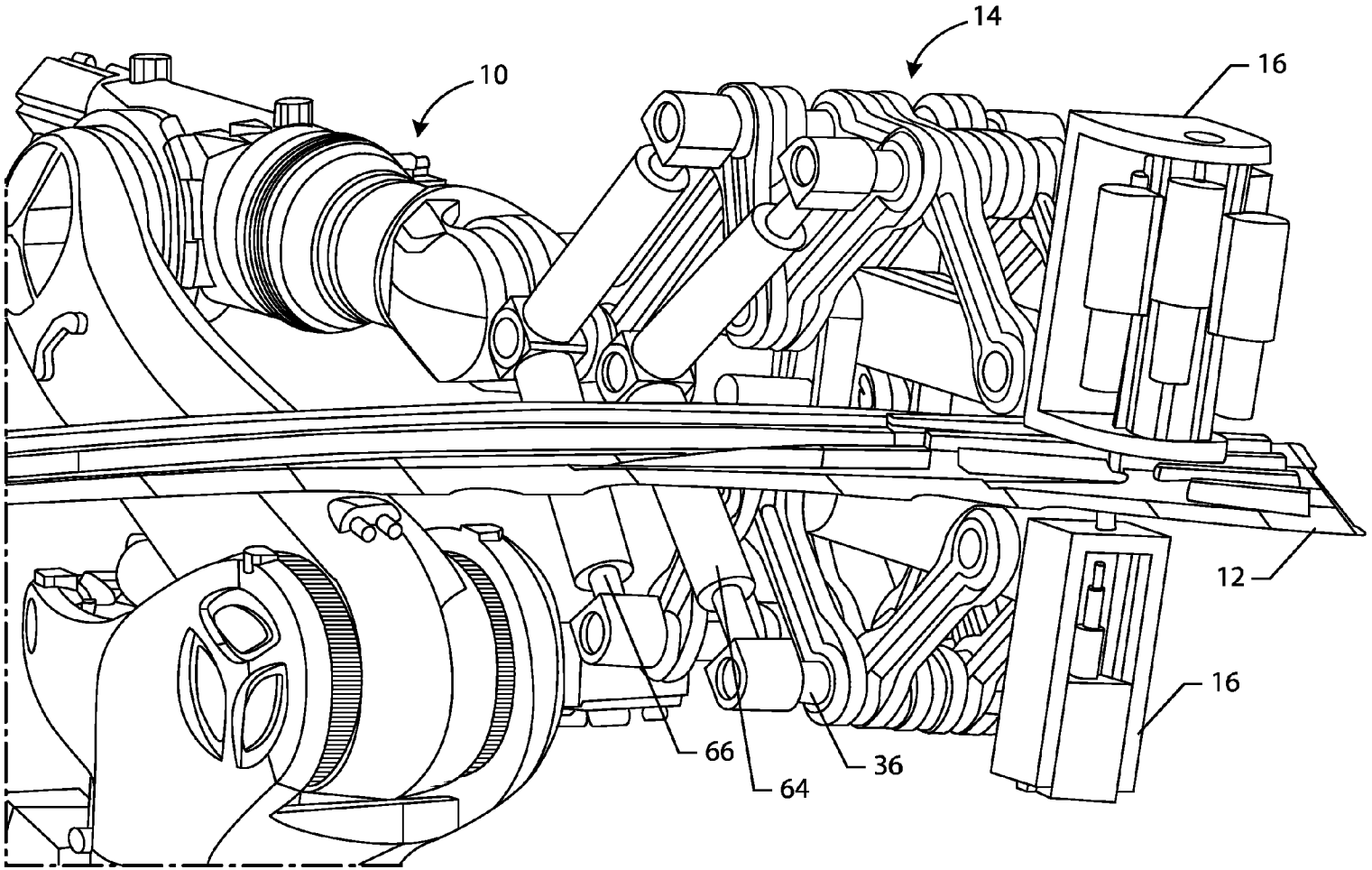
Figure 3:
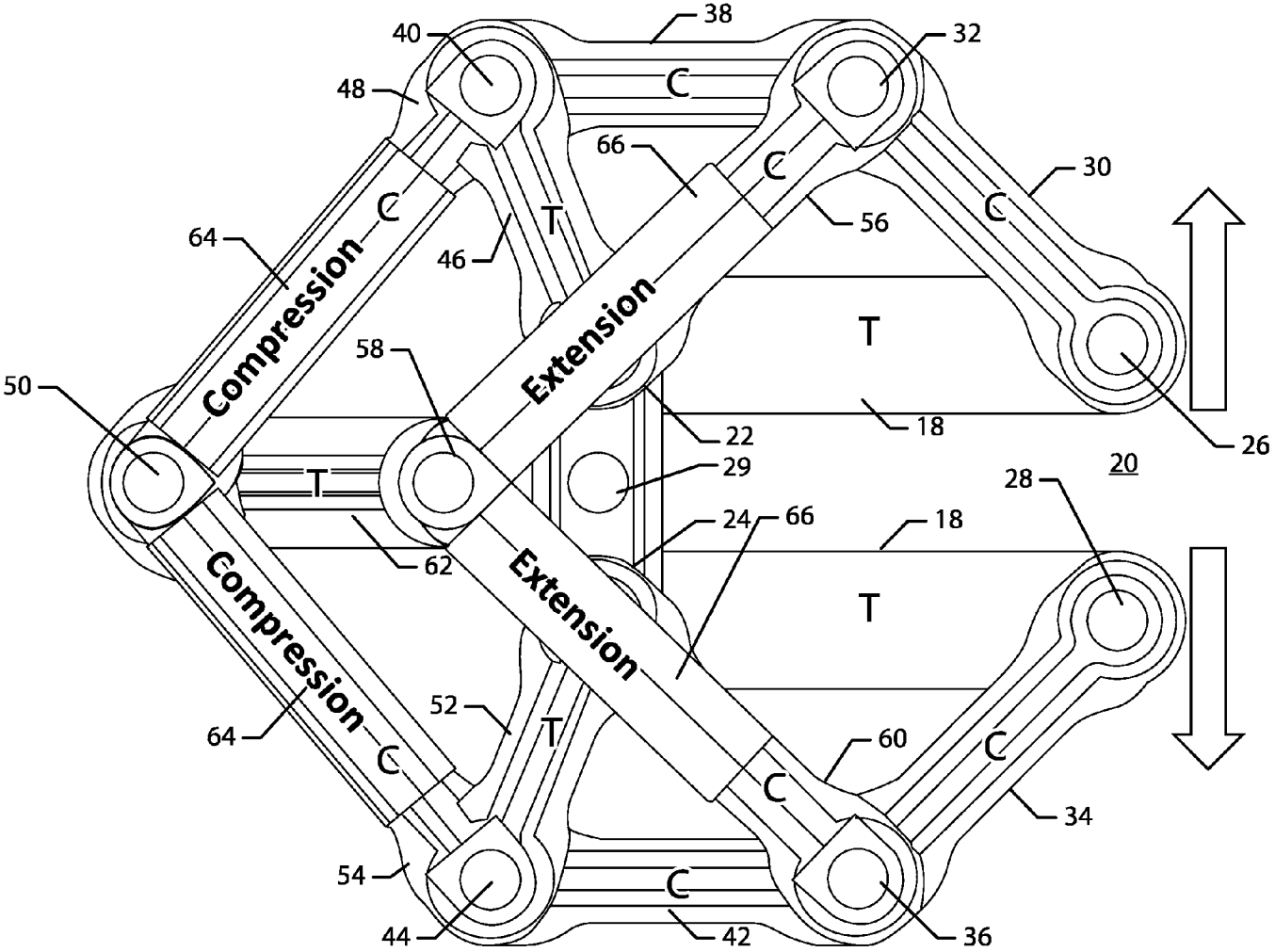
Figure 4:
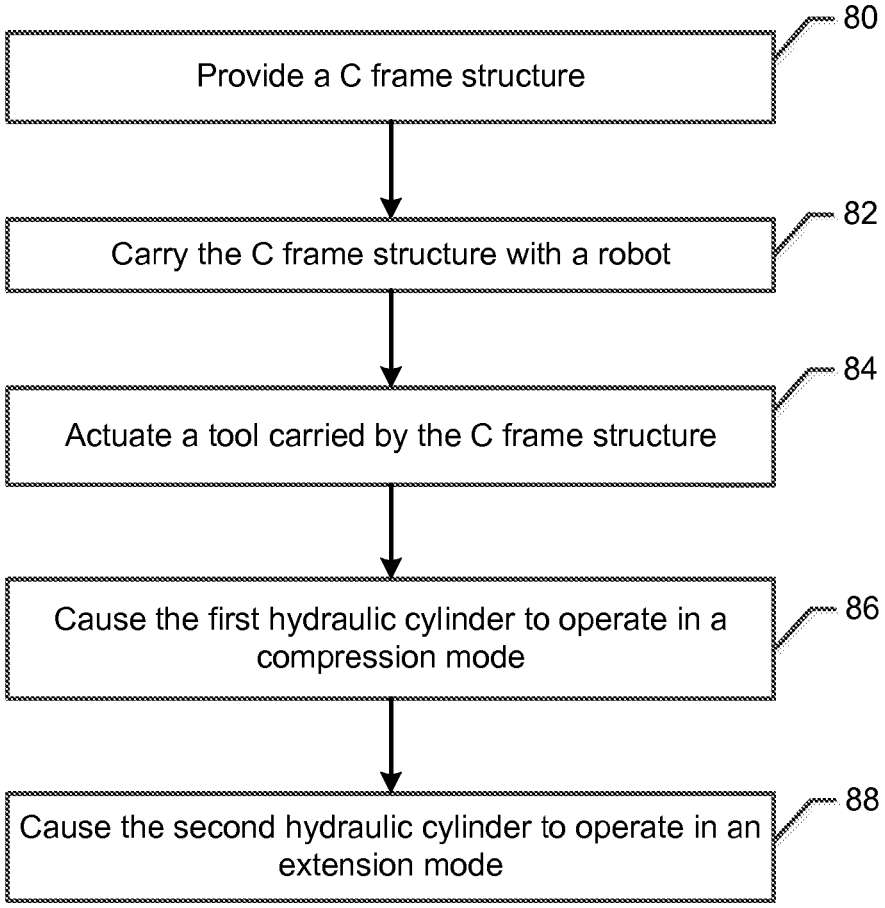
Figure 5:
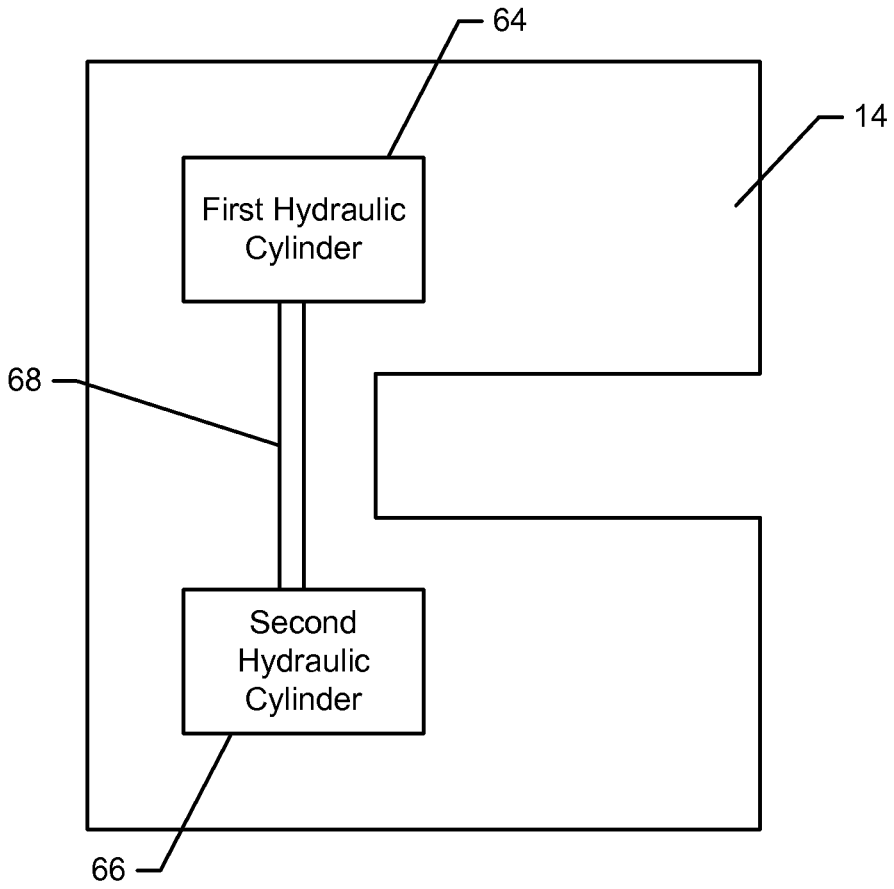
Figure 6:
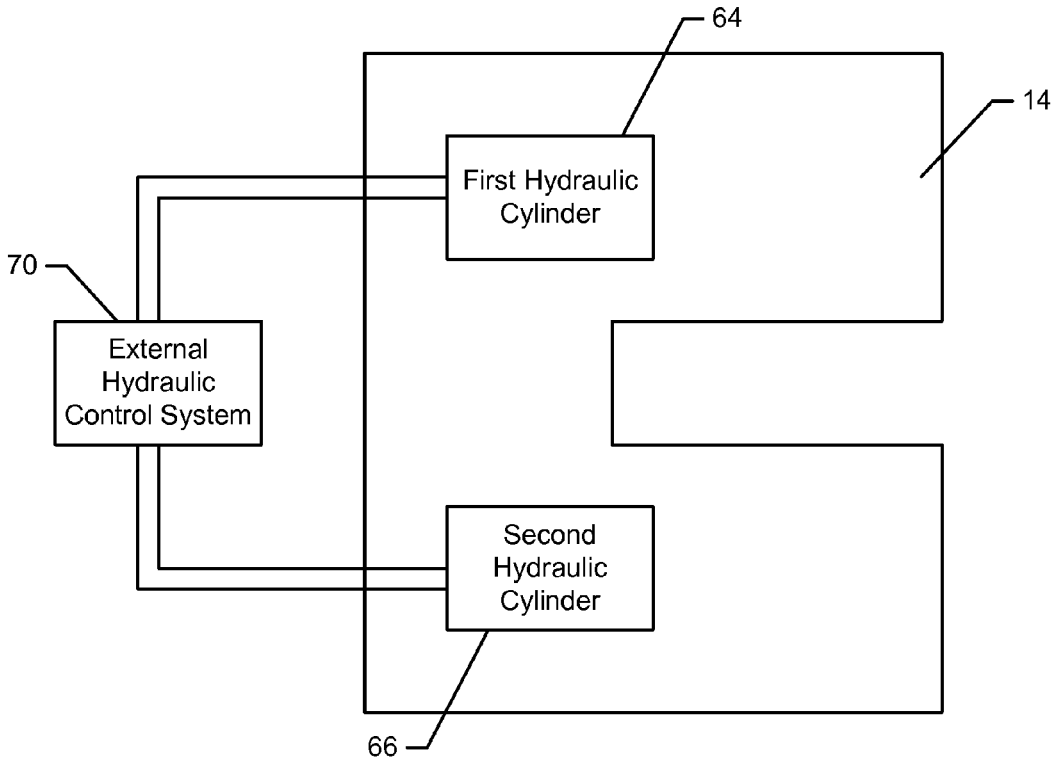

Having thus described certain embodiments of the present disclosure in general terms, reference will now be made to the accompanying drawings, which are not necessarily drawn to scale, and wherein:

FIG. 1 is a perspective view of a robotic system in accordance with one embodiment of the present disclosure;

FIG. 2 is a perspective view of the robotic system of FIG. 1 that is taken from a different vantage point in accordance with one embodiment of the present disclosure;

FIG. 3 is a side view of a C frame structure in accordance with one embodiment of the present disclosure;

FIG. 4 is a flowchart illustrating operations performed in accordance with one embodiment to the present disclosure;

FIG. 5 is a block diagram of a C frame structure having a passive hydraulic system in accordance with one embodiment of the present disclosure; and FIG. 6 is a block diagram of a C frame structure having an active hydraulic system in accordance with another embodiment of the present disclosure.

DETAILED DESCRIPTION

Embodiments of the present disclosure now will be described more fully hereinafter with reference to the accompanying drawings, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, a robotic system in accordance with one embodiment of the present disclosure is illustrated. The robotic system includes a robot 10 configured to provide for controlled movement of an end affecter. In this regard, the robot 10 may be configured to provide for movement in a plurality of directions including both linear and angular directions. In one embodiment, for example, the robot 10 may be configured for movement in six axes.

As described below, the robotic system may be configured in order to perform one or more operations, such as manufacturing operations, e.g., riveting, upon a workpiece. A workpiece in the form of a wing panel 12 is illustrated in FIGS. 1 and 2 and will be described below with respect to a robotic system serving to install a plurality of rivets into the wing panel, such as to secure a plurality of stringers to the wing skin. However, the robotic system of other embodiments may be configured to perform different manufacturing operations upon different types of workpieces including workpieces outside of the aircraft industry.

As shown in FIGS. 1-3, the end effector of the illustrated embodiment includes a C frame structure 14 that is carried by the robot 10 and may be controllably positioned by the robot relative to a workpiece. Thus, as shown in blocks 80 and 82 of FIG. 4, a C frame structure 14 may be provided that is carried by the robot 10. The C frame structure 14 may include a pair of jaws that define an opening therethrough. The robot 10 may therefore controllably position the C frame structure 14 of this embodiment relative to a workpiece, e.g., a wing panel 12, such that the workpiece extends through the opening defined by the C frame structure. The opposed jaws of the C frame structure 14 of this embodiment are positioned in alignment with one another on the opposite sides of the workpiece.

As also shown in FIGS. 1 and 2, the robotic system of one embodiment may include a tool 16 carried by the C frame structure 14. Although the robotic system may include a variety of tools 16, the tool of the illustrated embodiment includes a riveter having first and second riveting assemblies positioned in alignment on opposite sides of the workpiece, thereby facilitating installation of rivets through the workpiece in response to actuation by the robot 10. As shown in block 84 of FIG. 4, the tool 16 carried by the C frame structure 14 may be actuated, such as by the robot 10.

The C frame structure 14 includes a plurality of links interconnected by pins so as to form a pinned truss configuration. The pinned truss configuration may remove many, if not all, of the bending loads from the C frame structure 14 that may otherwise be generated in response to actuation of the tool 16. Instead, the pinned truss configuration may cause all load paths to be supported by members that are placed in either tension or compression. As described below, the pinned truss configuration differs from a fixed end cantilevered beam load scenario by removing bending loads from the structure. Additionally, the pinned truss configuration may advantageously distribute the strain density throughout the structure.

While the pinned truss configuration may have various configurations, the pinned truss configuration of the illustrated embodiment of FIG. 3 includes a pair of jaw members 18 that extend parallel to one another so as to define the opening 20 through which the workpiece extends. The jaw members 18 may extend outwardly from their proximal ends that are connected to pins 22, 24 to their distal ends connected to pins 26, 28. The proximal ends of the jaw members 18 may also be connected by one or more links 29 that extend between pins 22 and 24. The plurality of links of the illustrated embodiment also include two or more links 30 that are connected to pin 26 and that extend at an angle from the distal end of a respective jaw member 28 to a first side of the C frame structure 14. At the first side of the C frame structure 14, the links 30 may be connected to pin 32. The plurality of links may also include two or more links 34 that are connected to pin 28 and that extend at an angle from the distal end of a respective jaw member 18 to a second side of the C frame structure 14, opposite the first side. At the second side of the C frame structure 14, the links 34 may be connected to pin 36.

The plurality of links of the illustrated embodiment also include two or more links 38 that extend along the first side portion of the C frame structure 14 from pin 32 to pin 40 and two or more links 42 that extend along the second side of the C frame structure from pin 36 to pin 44. From pin 40, the plurality of links of the illustrated embodiment also include two or more links 46 that extend at an angle to pin 22 at the proximal end of a respective jaw member 18 and two or more links 48 that extend at an angle to pin 50, positioned opposite to the opening defined by the jaw members. Similarly, from pin 44, the plurality of links of the illustrated embodiment include two or more links 52 that extend at an angle to pin 24 at the proximal end of a respective jaw member 18 and two or more links 54 that extend at an angle to pin 50. The plurality of links of the illustrated embodiment may also include two or more links 56 that extend at an angle from pin 32 to pin 58 positioned in alignment with, but rearward of the opening defined by the jaw members 18. Similarly, the plurality of links of the illustrated embodiment may also include two or more links 60 that extend at an angle from pin 36 to pin 58. Finally, the plurality of links may include two or more links 62 that extend between pins 50 and 58 so as to be in general alignment with the opening defined by the jaw members 18.

The jaw members 18 may be configured to carry the tool 16 such that the tool may be controllably positioned relative to a workpiece that may extend through the opening 20 defined by the jaw members. In response to actuation of the tool 16 by the robot 10, deflection forces may be imparted upon the distal ends of the jaw members 18 that tend to force the distal ends of the jaw members away from one another as shown by the upwardly and downwardly directed arrows of FIG. 3. As a result of the strain imparted upon the C frame structure 14 as a result of the deflection created by the actuation of the tool 16, a plurality of the links, such as links 30, 34, 38, 42, 48, 54, 56 and 60, are placed in compression as represented by the C in the embodiment of FIG. 3 and a plurality of the links, such as jaw members 18 and links 46, 52 and 62, are placed in tension as represented by T in the embodiment of FIG. 3. In order to appropriately respond to the compressive or tensile forces placed upon respective ones of the links, the links that are placed in compression in response to actuation of the tool 16 may be formed of a different material than the links that are placed in compression in response to actuation of the tool. In this regard, the links that are placed in compression may be formed of a metal, such as aluminum, while the links that are placed in tension may be formed of an anisotropic material, such as a composite material, e.g., a carbon fiber material, that has a higher specific stiffness than steel or aluminum. In one embodiment, one or more of the links may be pre-buckled such that the respective link(s) may lengthen itself in response to the anticipated working loads, thereby also compensating for the deflection.

In order to accommodate the deflection imparted to the C frame structure 14 in response to actuation of the tool 16, the C frame structure may also include a plurality of hydraulic cylinders. The hydraulic cylinders may be connected to the plurality of links such that each hydraulic cylinder extends in parallel to a respective link. In this regard, the plurality of hydraulic cylinders may be connected so as to extend between a pair of pins of the pinned truss configuration. The C frame structure 14 of the embodiment illustrated in FIG. 3 includes one or more first hydraulic cylinders 64 configured to operate in a compression mode in response to the strain within the C frame structure attributable to the actuation of the tool 16. See block 86 of FIG. 4. In the illustrated embodiment, the C frame structure 14 includes two pair of first hydraulic cylinders 64 with one pair positioned on each side of the C frame structure. Each of the first hydraulic cylinders 64 may be connected to pin 50 and may extend angularly in opposite directions therefrom to pins 40 and 44 positioned at the first and second sides of the C frame structure 14, respectively. Additionally, the plurality of hydraulic cylinders may include one or more second hydraulic cylinders 66 configured to be in an extension mode in response to the first hydraulic cylinder(s) 64 operating in the compression mode. See block 88 of FIG. 4. In the illustrated embodiment, the C frame structure 14 may also include two pairs of second hydraulic cylinders 66 that extend angularly from pin 58 in opposite directions to pins 24 and 36 positioned at the first and second sides of the C frame structure, respectively.

Each hydraulic cylinder may include hydraulic fluid disposed within a cylinder housing. Each hydraulic cylinder may also include a piston disposed within the cylinder housing and attached via a shaft to a respective pin. The piston is configured to move lengthwise within the cylinder housing in response to the links with which the hydraulic cylinders extend in parallel being placed in tension or compression.

In order to accommodate the deflection otherwise created within the C frame structure 14 in response to actuation of the tool 16, the pair of first hydraulic cylinders 64 may operate in a compression mode such that the pistons of the first hydraulic cylinders force fluid therefrom, while the pair of second hydraulic cylinders 66 operate in an extension mode by receiving additional hydraulic fluid that, in turn, causes the shaft to be further extended relative to the respective cylinder housing. See blocks 86 and 88 of FIG. 4. In one embodiment, the hydraulic system may be a passive hydraulic system as shown schematically in FIG. 5. In this regard, a hydraulic fluid conduit 68 (not shown in FIG. 3) may interconnect the pair of first hydraulic cylinders 64 with the pair of second hydraulic cylinders 66. As such, movement of the pistons within the cylinder housings of the first hydraulic cylinders 64 may force hydraulic fluid outwardly from the first hydraulic cylinders. The hydraulic fluid may pass through the hydraulic fluid conduit 68 and enter the cylinder housings of the second hydraulic cylinders 66 so as to force the pistons of the second hydraulic cylinders through the cylinder housings so as to extend the shafts extending outwardly therefrom. Once the forces that otherwise cause deflection within the C frame structure 14 have been removed, the hydraulic fluid may flow in the opposite direction from the second hydraulic cylinders 66 to the first hydraulic cylinders 64 so as to return the hydraulic cylinders to their neutral, e.g., neither extended nor compressed, positions.

In another embodiment shown schematically in FIG. 6, the C frame structure 14 may include an external hydraulic control system 70. The external hydraulic control system 70 may include a pump and an accumulator or reservoir in fluid communication, such as via respective hydraulic fluid conduits, with the first hydraulic cylinders 64 and the second hydraulic cylinders 66. As such, in response to actuation of the tool 16 and the resulting deflection otherwise created within the C frame structure 14, the first hydraulic cylinders 64 may force hydraulic fluid outwardly therefrom to the external hydraulic control system 70. In response, the external hydraulic control system 70 may detect the hydraulic fluid provided by the first hydraulic cylinders 64 and may, in turn, force hydraulic fluid, such as an equal amount of hydraulic fluid, to the second hydraulic cylinders 66 so as to cause the second hydraulic cylinders to extend, thereby offsetting the deflection forces otherwise created by actuation of the tool 16. Once the forces that otherwise cause deflection within the C frame structure 14 have been removed, the external hydraulic control system may cause the hydraulic fluid to flow in the opposite direction so as to return the hydraulic cylinders to their neutral, e.g., neither extended nor compressed, positions.

By operating the first and second hydraulic cylinders 64, 66 in concert as described above, the deflection that is otherwise created at the distal ends of the jaw members 18 may be reduced. As such, the C frame structure 14 may be formed of links that provide the requisite strength to withstand the forces created during actuation of the tool 16 with the assistance of the hydraulic cylinders, but without having to be as heavy as required by some conventional tooling. Thus, the C frame structure 14 may be carried by a robot 10 so to be controllably positioned relative to a workpiece, such as a wing panel 12. Thus, the resulting manufacturing process, such as the riveting operations performed with respect to the workpiece, may be performed more quickly and efficiently in accordance with an example embodiment of the present disclosure.

Many modifications and other embodiments set forth herein will come to mind to one skilled in the art to which these embodiments pertain having the benefit of the teachings presented in the foregoing descriptions and the associated drawings. Therefore, it is to be understood that the embodiments are not to be limited to the specific ones disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions other than those explicitly described above are also contemplated as may be set forth in some of the appended claims. Although specific terms are employed herein, they are used in a generic and descriptive sense only and not for purposes of limitation.

What is claimed is:

1. A C frame structure for carrying a tool, the C frame structure comprising:

a plurality of links;

a plurality of pins interconnecting the links to form a C-shaped pinned truss configuration including first and second jaw members that each extend from a proximal end to a distal end and that cooperate to define an opening configured to receive a workpiece, wherein the plurality of links comprise a first set of links including first links interconnected by pins to the proximal and distal ends of the first jaw member and second links interconnected by pins to the first links, wherein the plurality of links further comprise a second set of links including first links interconnected by pins to the proximal and distal ends of the second jaw member and second links interconnected by pins to the first links, wherein respective second links of the first and second sets of links are interconnected by a pin, wherein at least one of the jaw members is configured to carry the tool, wherein the pinned truss configuration of the links is responsive to a deflection force imparted upon the jaw members and corresponding deflection of the C frame structure in response to actuation of the tool such that each link is placed in compression or tension; and a plurality of hydraulic cylinders connected to the plurality of links such that each hydraulic cylinder extends in parallel to a respective link, wherein the plurality of hydraulic cylinders comprise a pair of first hydraulic cylinders that diverge from a common point so as to extend in parallel to the respective second links that are interconnected by a pin and are configured to operate in a compression mode in response to strain within the C frame structure attributable to the actuation of the tool, and wherein the plurality of hydraulic cylinders further comprise a pair of second hydraulic cylinders that diverge from a common point so as to extend in parallel to a respective second link and are configured to be in an extension mode in response to the first hydraulic cylinders operating in the compression mode.

2. A C frame structure according to claim 1 wherein the first and second hydraulic cylinders are in fluid communication such that hydraulic fluid forced out of the first hydraulic cylinders in the compression mode is provided to the second hydraulic cylinders.

3. A C frame structure according to claim 2 wherein each of the first and second hydraulic cylinders comprise a piston, and wherein the each first hydraulic cylinder is configured to cause the respective piston to force hydraulic fluid out of the first hydraulic cylinder in the compression mode.

4. A C frame structure according to claim 1 further comprising an external hydraulic control system configured to direct hydraulic fluid to the second hydraulic cylinders in response to operation of the first hydraulic cylinders in the compression mode.

5. A C frame structure according to claim 1 wherein the links configured to be placed in tension are comprised of an anisotropic material.

6. A C frame structure according to claim 5 wherein the links configured to be placed in tension are comprised of a composite material.

7. A C frame structure according to claim 1 wherein the links configured to be placed in compression are comprised of a metal.

8. A robotic system comprising:

a robot configured to provide for controlled movement;

a C frame structure carried by the robot, wherein the C frame structure comprises a pinned truss configuration comprising a plurality of links interconnected by pins with the pinned truss configuration including first and second jaw members that each extend from a proximal end to a distal end and that cooperate to define an opening configured to receive a workpiece, wherein the plurality of links comprise a first set of links including first links interconnected by pins to the proximal and distal ends of the first jaw member and second links interconnected by pins to the first links, wherein the plurality of links further comprise a second set of links including first links interconnected by pins to the proximal and distal ends of the second jaw member and second links interconnected by pins to the first links, wherein respective second links of the first and second sets of links are interconnected by a pin, wherein at least one of the jaw members is configured to carry the tool, and wherein the C frame structure further comprises a plurality of hydraulic cylinders including first and second hydraulic cylinders connected to the plurality of links such that each hydraulic cylinder extends in parallel to a respective link, wherein the plurality of hydraulic cylinders comprise a pair of first hydraulic cylinders that diverge from a common point so as to extend in parallel to the respective second links that are interconnected by a pin, and wherein the plurality of hydraulic cylinders further comprise a pair of second hydraulic cylinders that diverge from a common point so as to extend in parallel to a respective second link; and a tool carried by at least one of the links, wherein the pinned truss configuration of the links is responsive to a deflection force imparted upon the jaw members and corresponding deflection of the C frame structure in response to actuation of the tool by the robot such that each link is placed in compression or tension, wherein the pair of first hydraulic cylinders are configured to operate in a compression mode in response to strain within the C frame structure attributable to the actuation of the tool, and wherein the pair of second hydraulic cylinders are configured to be in an extension mode in response to the first hydraulic cylinders operating in the compression mode.

9. A robotic system according to claim 8 wherein the tool comprises a riveter.

10. A robotic system according to claim 8 wherein the first and second hydraulic cylinders are in fluid communication such that hydraulic fluid forced out of the first hydraulic cylinders in the compression mode is provided to the second hydraulic cylinders.

11. A robotic system according to claim 10 wherein each of the first and second hydraulic cylinders comprise a piston, and wherein the each first hydraulic cylinder is configured to cause the respective piston to force hydraulic fluid out of the first hydraulic cylinder in the compression mode.

12. A robotic system according to claim 8 further comprising an external hydraulic control system configured to direct hydraulic fluid to the second hydraulic cylinders in response to operation of the first hydraulic cylinders in the compression mode.

13. A robotic system according to claim 8 wherein the links configured to be placed in tension are comprised of an anisotropic material.

14. A robotic system according to claim 13 wherein the links configured to be placed in tension are comprised of a composite material.

15. A robotic system according to claim 8 wherein the links configured to be placed in compression are comprised of a metal.

16. A method for accommodating deflection upon actuation of a tool, the method comprising:

providing a C frame structure that comprises a pinned truss configuration comprising a plurality of links interconnected by pins with the pinned truss configuration including first and second jaw members that each extend from a proximal end to a distal end and that cooperate to define an opening configured to receive a workpiece, wherein the plurality of links comprise a first set of links including first links interconnected by pins to the proximal and distal ends of the first jaw member and second links interconnected by pins to the first links, wherein the plurality of links further comprise a second set of links including first links interconnected by pins to the proximal and distal ends of the second jaw member and second links interconnected by pins to the first links, wherein respective second links of the first and second sets of links are interconnected by a pin, wherein at least one of the jaw members is configured to carry the tool, and wherein the C frame structure further comprises a plurality of hydraulic cylinders connected to the plurality of links such that each hydraulic cylinder extends in parallel to a respective link, wherein the plurality of hydraulic cylinders comprise a pair of first hydraulic cylinders that diverge from a common point so as to extend in parallel to the respective second links that are interconnected by a pin, and wherein the plurality of hydraulic cylinders further comprise a pair of second hydraulic cylinders that diverge from a common point so as to extend in parallel to a respective second link;

actuating a tool carried by the C frame structure, wherein the pinned truss configuration of the links is responsive to a deflection force imparted upon the jaw members and corresponding deflection of the C frame structure in response to the actuation of the tool such that each link is placed in compression or tension;

causing the pair of first hydraulic cylinders to operate in a compression mode in response to strain within the C frame structure attributable to the actuation of the tool; and causing the pair of second hydraulic cylinders to operate in an extension mode in response to the first hydraulic cylinders operating in the compression mode.

17. A method according to claim 16 further comprising carrying the C frame structure with a robot, wherein actuating the tool comprises actuating a riveter.

18. A method according to claim 16 wherein the causing the first hydraulic cylinders to operate in the compression mode comprises forcing hydraulic fluid out of the first hydraulic cylinders in the compression mode, and wherein causing the second hydraulic cylinders to operate in the extension mode comprises providing the hydraulic fluid forced out of the first hydraulic cylinders to the second hydraulic cylinders.

19. A method according to claim 18 wherein each of the first and second hydraulic cylinders comprise a piston, and wherein forcing hydraulic fluid out of the first hydraulic cylinders in the compression mode comprises causing the respective pistons to force hydraulic fluid out of the first hydraulic cylinders in the compression mode.

20. A method according to claim 16 wherein causing the first hydraulic cylinders to operate in the compression mode comprises causing hydraulic fluid to be forced from the first hydraulic cylinders to an external hydraulic control system, and wherein causing the second hydraulic cylinders to operate in the extension mode comprises causing the external hydraulic control system to direct hydraulic fluid to the second hydraulic cylinders in response to operation of the first hydraulic cylinders in the compression mode.

* * * * *